US009378691B2

(12) United States Patent
Gotoh et al.

(10) Patent No.: US 9,378,691 B2
(45) Date of Patent: Jun. 28, 2016

(54) DISPLAY DEVICE AND METHOD FOR DRIVING DISPLAY DEVICE

(71) Applicant: Japan Display Inc., Tokyo (JP)

(72) Inventors: Fumitaka Gotoh, Tokyo (JP); Tsutomu Harada, Tokyo (JP); Masaaki Kabe, Tokyo (JP); Tae Kurokawa, Tokyo (JP); Kojiro Ikeda, Tokyo (JP); Toshiyuki Nagatsuma, Tokyo (JP); Akira Sakaigawa, Tokyo (JP); Naoyuki Takasaki, Tokyo (JP); Amane Higashi, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 14/936,435

(22) Filed: Nov. 9, 2015

(65) Prior Publication Data

US 2016/0063935 A1 Mar. 3, 2016

Related U.S. Application Data

(63) Continuation of application No. 14/505,145, filed on Oct. 2, 2014, now Pat. No. 9,214,118.

(30) Foreign Application Priority Data

Oct. 22, 2013 (JP) ..... 2013-219703

(51) Int. Cl.

| | |
|---|---|
| ***G09G 5/02*** | (2006.01) |
| ***G09G 3/36*** | (2006.01) |
| ***G09G 5/10*** | (2006.01) |

(52) U.S. Cl.

CPC ..... *G09G 3/3607* (2013.01); *G09G 5/10* (2013.01); *G09G 2300/0452* (2013.01)

(58) Field of Classification Search

CPC ..... G09G 1/00; G09G 3/36; G09G 5/02; G09G 3/3413; G09G 2310/0235; G09G 2320/0646; G06F 1/00

See application file for complete search history.

(56) References Cited

U.S. PATENT DOCUMENTS

2005/0184998 A1 8/2005 Yang et al.
2012/0249404 A1* 10/2012 Sakaigawa ..... G09G 3/2003 345/88

FOREIGN PATENT DOCUMENTS

| | | | |
|---|---|---|---|
| JP | 2005-242300 | | 9/2005 |
| JP | 2007-206560 | A | 8/2007 |
| JP | 2010-033009 | A | 2/2010 |
| KR | 2008-0062185 | A | 7/2008 |
| KR | 2011-0088398 | A | 8/2011 |

* cited by examiner

*Primary Examiner* — Michael Faragalla
(74) *Attorney, Agent, or Firm* — Michael Best & Friedrich LLP

(57) ABSTRACT

A display device includes: an image display unit that includes a plurality of main pixels in an image display region, the image display unit including sub-pixels; a light source that irradiates the image display region; a light source control unit that controls luminance of the light source; and a color information correction processing unit that corrects first color information that is obtained based on the luminance of the light source and an input video signal to second color information, when color information of at least one of a red pixel, a green pixel, and a blue pixel included in the first color information exceeds a predetermined threshold, the second information is corrected by degenerating color information of the red pixel, the green pixel, and the blue pixel, and by adding color information of the white pixel included in the first color information based on the degenerated color information.

8 Claims, 17 Drawing Sheets

DISPLAY DEVICE AND METHOD FOR DRIVING DISPLAY DEVICE

CROSS-REFERENCE TO RELATED APPLICATIONS

The present application is a Continuation of application Ser. No. 14/505,145, filed Oct. 2, 2014, and contains subject matter related to Japanese Application No. 2013-219703, filed on Oct. 22, 2013, the entire contents of which are incorporated herein by reference.

BACKGROUND

1. Technical Field

The present disclosure relates to a display device including an image display unit in which an image display region is provided, a method for driving the display device, and an electronic apparatus.

2. Description of the Related Art

In recent years, RGBW-type display devices have attracted attention that uses a white (W) pixel in addition to a red (R) pixel, a green (G) pixel, and a blue (B) pixel (for example, refer to Japanese Patent Application Laid-open Publication No. 2005-242300). In the RGBW-type display device, white can be highlighted by using the white pixel, so that light source luminance can be reduced as compared with conventional RGB-type display devices and a high-saturation image (also called as a high-chroma image) can be displayed with low power consumption.

In the conventional RGBW-type display devices, to reduce the light source luminance, image expansion processing is performed for an input image signal to maintain value of a displayed image. In the image expansion processing, image data of the red pixel, the green pixel, and the blue pixel is extended corresponding to a rate of reduction in the light source luminance, and the common portion of the extended image data of the red pixel, the green pixel, and the blue pixel is replaced with image data of the white pixel.

However, in the conventional RGBW-type display devices, a ratio among the pieces of image data of the red pixel, the green pixel, and the blue pixel may be changed before and after the image expansion processing of the input image signal, a hue of the image may be deteriorated to be dark, and deterioration of display quality may be visually recognized in some cases.

For the foregoing reasons, there is a need for a display device that can reduce the entire power consumption of the device by reducing the light source luminance and prevent value (also called as brightness or luminance) and a hue from being deteriorated to reduce deterioration of display quality to be visually recognized, a method for driving the display device, and an electronic apparatus.

SUMMARY

According to an aspect, a display device include: an image display unit that includes a plurality of main pixels including sub-pixels that are a red pixel, a green pixel, a blue pixel, and a white pixel in an image display region;

a light source that irradiates the image display region with illumination light; a light source control unit that controls luminance of the light source; and a color information correction processing unit that corrects first color information to be displayed on a predetermined main pixel that is obtained based or the luminance of the light source and an input video signal to second color information, when color information of at least one of the red pixel, the green pixel, and the blue pixel included in the first color information exceeds a predetermined threshold, by degenerating the color information of the red pixel, the green pixel, and the blue pixel and adding color information of the white pixel included in the first color information based on the degenerated color information of the red pixel, the green pixel, and the blue pixel.

According to another aspect, a method for driving a display device, the method includes: degenerating color information of a red pixel, a green pixel, and a blue pixel included in first color information to be displayed on a predetermined main pixel that is obtained based on luminance of a light source and an input video signal when the color information of at least one of the red pixel, the green pixel, and the blue pixel included in the first color information exceeds a predetermined threshold; and correcting the first color information to second color information by adding color information of a white pixel included in the first color information based on the degenerated color information of the red pixel, the green pixel, and the blue pixel.

According to another aspect, an electronic apparatus includes: a display device including: an image display unit that includes a plurality of main pixels including sub-pixels that are a red pixel, a green pixel, a blue pixel, and a white pixel in an image display region; a light source that irradiates the image display region with illumination light; a light source control unit that controls luminance of the light source; and a color information correction processing unit that corrects first color information to be displayed on a predetermined main pixel that is obtained based on the luminance of the light source and an input video signal to second color information, when color information of at least one of the red pixel, the green pixel, and the blue pixel included in the first color information exceeds a predetermined threshold, by degenerating the color information of the red pixel, the green pixel, and the blue pixel and adding color information of the white pixel included in the first color information based on the degenerated color information of the red pixel, the green pixel, and the blue pixel; and a controller that controls the display device.

DETAILED DESCRIPTION

The following describes an embodiment of the present invention in detail with reference to the attached drawings. In the embodiment, a liquid crystal display device is used as an example of a display device. However, the invention can be applied to various display devices, not only to the liquid crystal display device.

Figure 1:
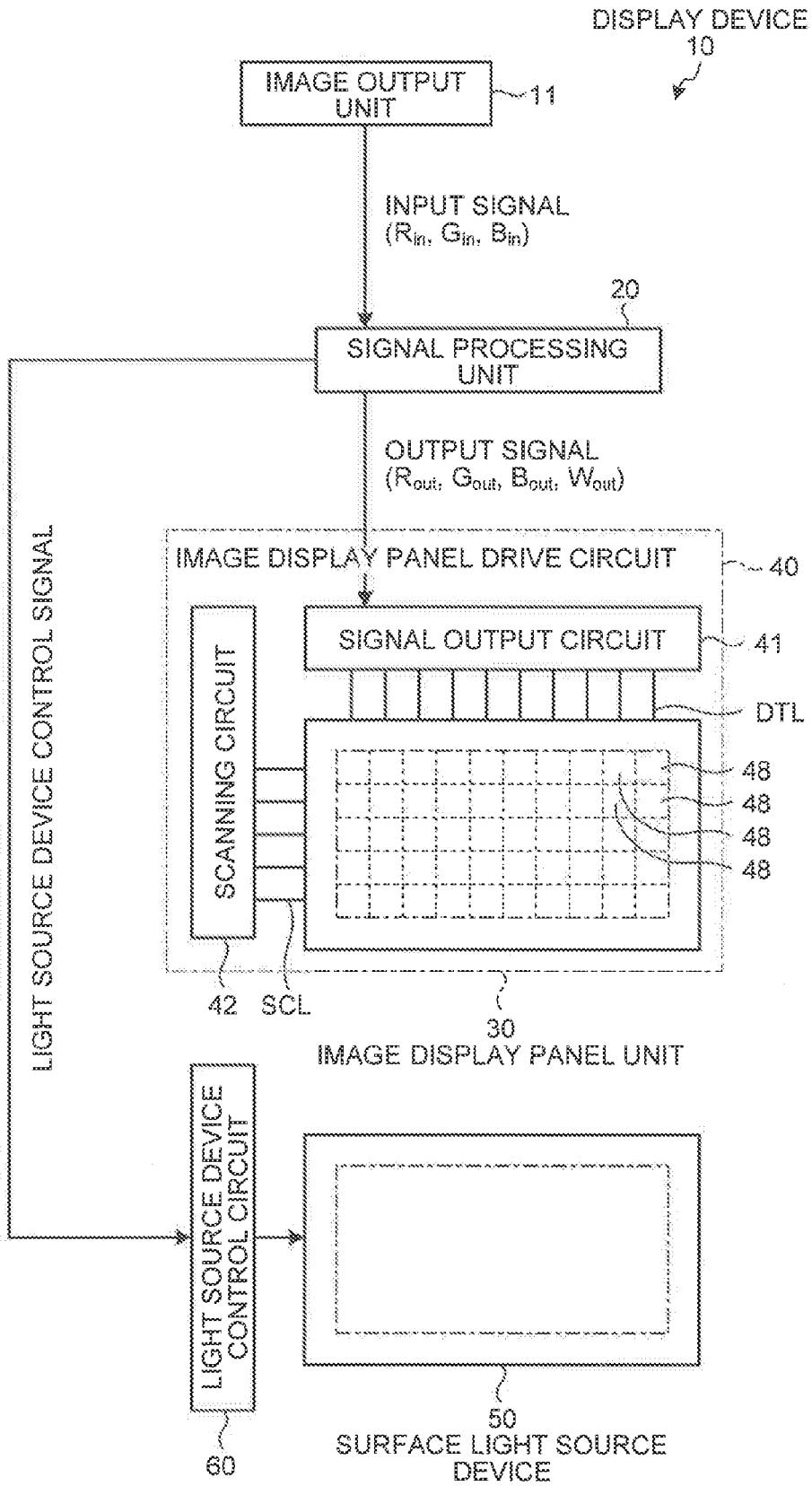
FIG. 1 is a functional block diagram illustrating a configuration example of a liquid crystal display device according to an embodiment of the present disclosure.
Figure 2:
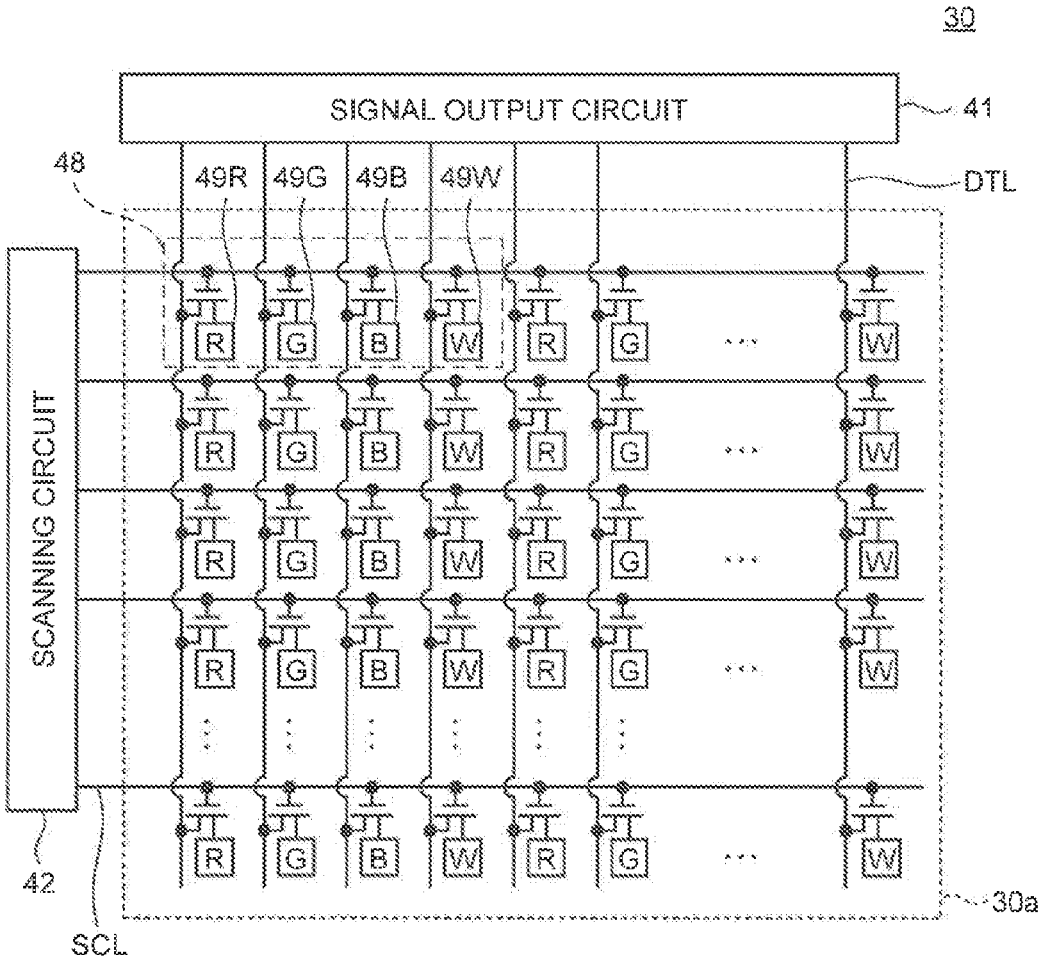
FIG. 2 is a wiring diagram of an image display panel unit in the liquid crystal display device illustrated in FIG. 1.

FIG. 1 is a functional block diagram illustrating a configuration example of a liquid crystal display device according to the embodiment. FIG. 2 is a wiring diagram of an image display panel unit in the liquid crystal display device illustrated in FIG. 1.

As illustrated in FIG. 1, a liquid crystal display device 10 (hereinafter, simply referred to as a "display device 10" in some cases) according to the embodiment includes a signal processing unit 20 that receives an input signal (RGB data) from an image output unit 11 and executes predetermined data conversion processing to output the signal, an image display panel unit 30 that displays an image based on the output signal output from the signal processing unit 20, an image display device drive circuit 40 that controls a display operation of the image display panel unit 30, a surface light source device 50 that irradiates an image display region 30*a* (not illustrated in FIG. 1, refer to FIG. 2) of the image display panel unit 30 with white light in a plane shape from the back surface of the image display panel unit 30, and a light source device control circuit (light source control unit) 60 that controls an operation of the surface light source device 50. The configuration of the display device 10 is similar to that of a display device assembly disclosed in Japanese Patent Application Laid-open Publication No. 2011-154323. Various modifications disclosed in Japanese Patent Application Laid-open Publication No. 2011-154323 can be applied to the display device 10.

The signal processing unit 20 is an arithmetic processing unit that controls operations of the image display panel unit 30 and the surface light source device 50. The signal processing unit 20 is electrically coupled to the image display device drive circuit 40 that drives the image display panel unit 30 and the light source device control circuit 60 that drives the surface light source device 50. The signal processing unit 20 executes data processing of the input signal (RGB data) that is input from the outside, outputs an output signal to the image display device drive circuit 40, and generates a light source device control signal to be output to the light source device control circuit 60.

After performing predetermined color conversion processing on input signals (Rin, Gin, Bin) as RGB data represented by an energy ratio among R (red), G (green), and B (blue), the signal processing unit 20 generates output signals (Rout, Gout, Bout, Wout) represented by an energy ratio among R (red), G (green), B (blue), and W (white), to which the fourth color W (white) is added. The signal processing unit 20 then outputs the generated output signals (Rout, Gout, Bout, Wout) to the image display device drive circuit 40, and outputs the light source device control signal to the light source device control circuit 60.

According to the embodiment, the signal processing unit 20 converts the input signals (Rin, Gin, Bin) into the output signals (Rout, Gout, Bout, Wout) to distribute quantity of transmitted light of the surface light source device 50 to a fourth sub-pixel 49W of a pixel 48 based on a W (white) component, so that the light can be transmitted from the fourth sub-pixel 49W of which light transmittance is the highest. Due to this, transmittance of the entire color filter can be improved, so that quantity of light passing through the color filter can be maintained even when the light output from the surface light source device 50 is reduced, and power consumption of the surface light source device 50 can be reduced while maintaining the value of the image.

Each of the input signals (Bin, Gin, Bin) is the RGB data indicating a specific color in the standard color gamut. Various standards to be applied to image display can be used as the standard color gamut. Examples thereof include, but are not limited to, the color gamut of the sRGB standard, the color gamut of the Adobe (registered trademark) RGB standard, and the color gamut of the NTSC standard. The sRGB standard is defined by the International Electrotechnical Commission (IEC). The Adobe (registered trademark) RGB standard is defined by Adobe Systems. The NTSC standard is defined by the National Television System Committee.

As illustrated in FIG. 2, the image display panel unit 30 is a color liquid crystal display device including the image display region 30*a*. In the image display region 30*a*, the pixel 48 including a first sub-pixel 49R for displaying a first color (red), a second sub-pixel 49G for displaying a second color (green), a third sub-pixel 49G for displaying a third color (blue), and the fourth sub-pixel 49W for displaying a fourth color (white) is arranged in a two-dimensional matrix. A first color filter for transmitting light of the first color (red) is arranged between the first sub-pixel 49G and a display surface of the image display panel unit 30. A second color filter for transmitting light of the second color (green) is arranged between the second sub-pixel 49G and the display surface of the image display panel unit 30. A third color filter for transmitting light of the third color (blue) is arranged between the third sub-pixel 49G and the display surface of the image display panel unit 30. A transparent resin layer for transmitting all colors is arranged between the fourth subpixel 49W and the display surface of the image display panel unit 30. There may be nothing between the fourth sub-pixel 49W and the display surface of the image display panel unit 30.

In the example illustrated in FIG. 2, the first sub-pixel 49R, the second sub-pixel 49G, the third sub-pixel. 49B, and the fourth sub-pixel 49W are arranged similarly to a stripe array in the image display panel unit 30. The configuration and arrangement of sub-pixels included in one pixel is not specifically limited. For example, in the image display panel unit 30, the first sub-pixel 49R, the second sub-pixel 49G, the third sub-pixel 49B, and the fourth sub-pixel 49W may be arranged similarly to a diagonal array (mosaic array). Alternatively, for example, they may be arranged similarly to a delta array (triangle array), a rectangle array, or the like. Generally, the arrangement similar to a stripe array is suitable for displaying data and character strings in a personal computer and the like. In contrast, the arrangement similar to a mosaic array is suitable for displaying a natural image in a video camera recorder, a digital still camera, and the like.

The image display device drive circuit 40 includes a signal output circuit 41 (signal output unit) and a scanning circuit 42. The signal output circuit 41 is electrically coupled to each sub-pixel in each pixel 48 of the image display panel unit 30 via wiring diode-transistor logic (DTL). The signal output circuit 41 outputs a driving voltage to be applied to a liquid crystal included in each sub-pixel based on the output signals (Rout, Gout, Bout, Wout) output from the signal processing unit 20, and controls transmittance of light emitted from the surface light source device 50 for each pixel 48. The scanning circuit 42 is electrically coupled, via wiring switch control logic (SCL), to a switching element for controlling an operation of each sub-pixel in each pixel 48 of the image display panel unit 30. The scanning circuit 42 sequentially outputs scanning signals to a plurality of pieces of wiring SCL, and applies each of the scanning signals to the switching element of the sub-pixel in each pixel 48 to turn ON the switching element. The signal output circuit 41 applies the driving voltage to the liquid crystal included in the sub-pixel to which the scanning signal from the scanning circuit 42 is applied. In this way, an image is displayed on the entire image display region 30*a* of the image display panel unit 30.

The surface light source device 50 is a backlight including various light sources and arranged on the back surface of the image display panel unit 30. The surface light source device 50 illuminates the image display panel unit 30 by emitting light from the light source to the image display panel unit 30.

The light source device control circuit 60 controls lighting quantity and/or a load of the light source in the surface light source device 50 based on the light source device control signal output from the signal processing unit 20, and adjusts an amount of light and intensity of light emitted from the surface light source device 50 to the image display panel unit 30. The light source device control circuit 60 can also control the light source and the intensity of light by controlling the lighting quantity and/or the load of part of the light sources.

Figure 3:
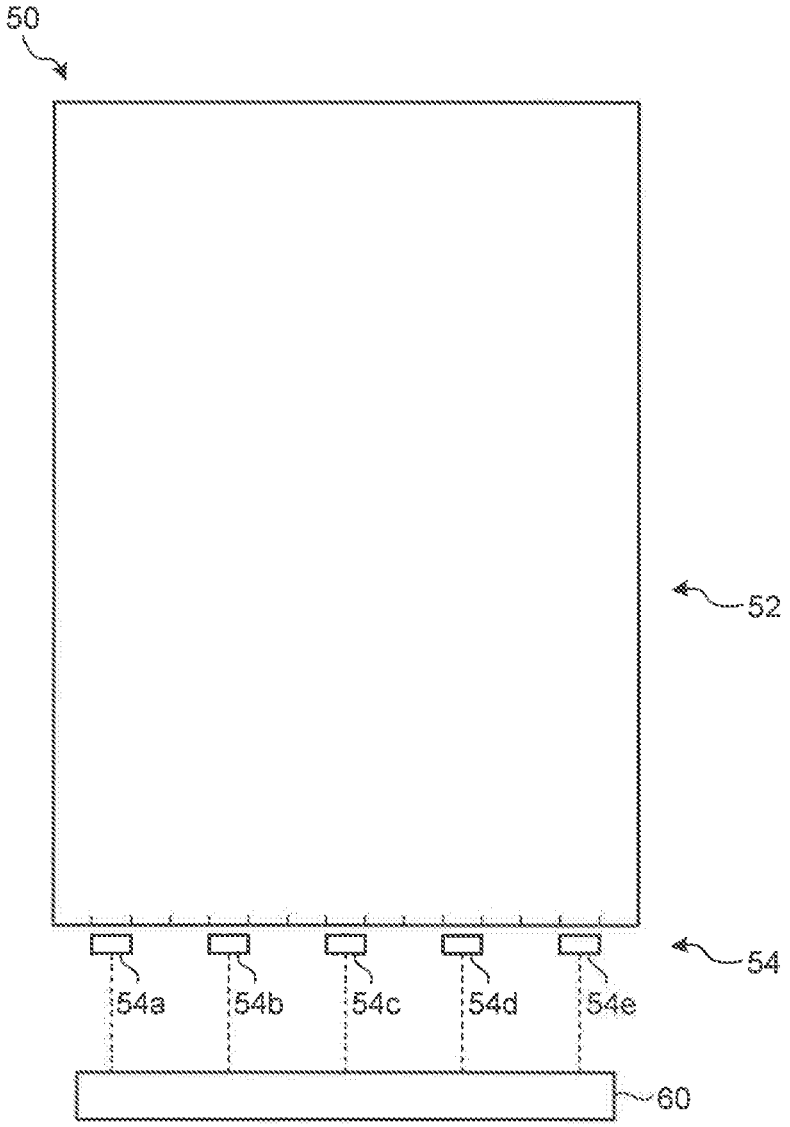
FIG. 3 is a schematic diagram of a surface light source device according to the embodiment of the present disclosure.

FIG. 3 is a schematic diagram of the surface light source device 50 according to the embodiment. As illustrated in FIG. 3, the surface light source device 50 includes a light guide plate 52 and a light source 54 arranged in the vicinity of an end face of the light guide plate 52. The light, source 54 includes five light-emitting diodes (LEDs) 54*a* to 54*e* as point light sources arranged at predetermined intervals along one direction. An optical sheet and the like (not illustrated) are arranged on an emitting surface side of the light guide plate 52, a reflective sheet (not illustrated) is arranged on a surface opposed to the emitting surface of the light guide plate 52. The five LEDs 54*a* to 54*e* are electrically coupled to the light source device control circuit 60. The light guide plate 52 guides the light emitted from the five LEDs 54*a* to 54*e* to the inside via the end face, and emits the light guided to the inside toward the image display panel unit 30 from a principal plane. In the example of the embodiment, the light source 54 includes the five LEDs 54*a* to 54*e*. Alternatively, the number of LEDs 54*a* to 54*e* included in the light source 54 may be appropriately modified. The light source 54 is not limited to the LEDs 54*a* to 54*e*, and may be configured using various point light sources and line light sources.

Figure 4:
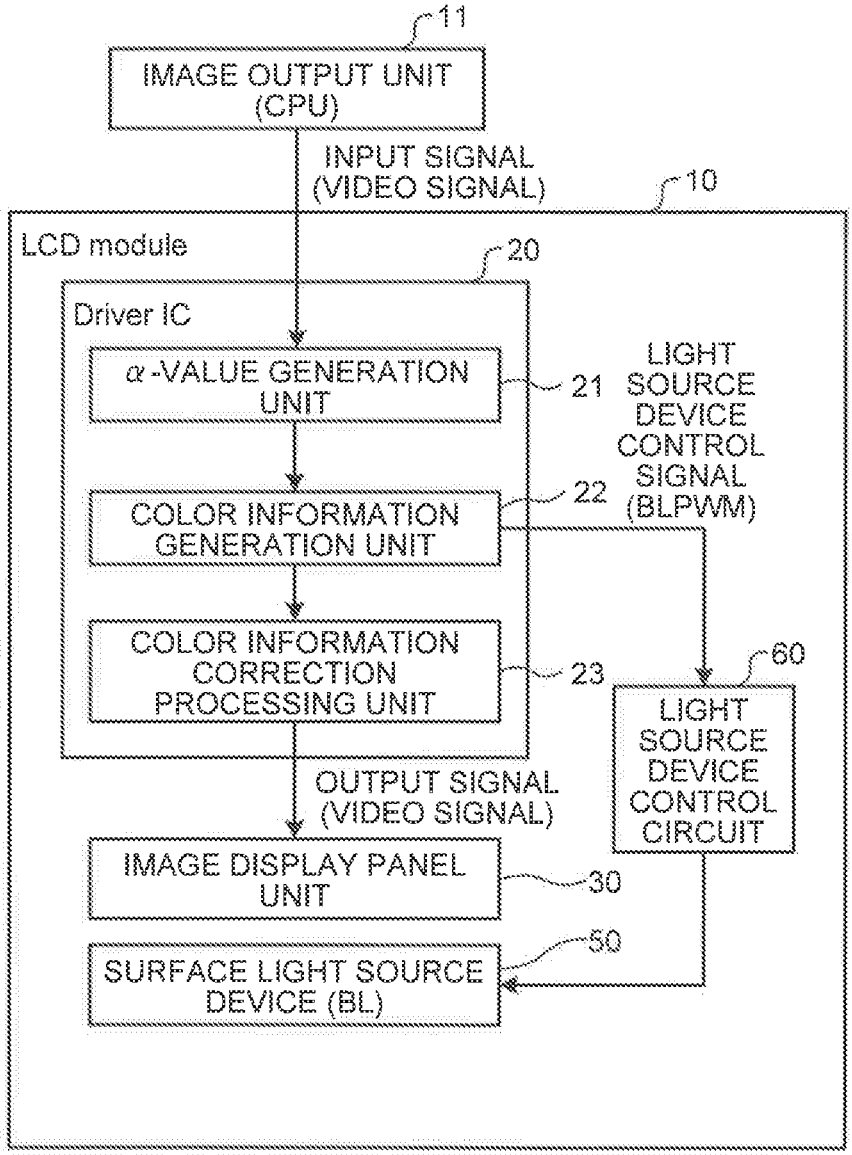
FIG. 4 is a functional block diagram of surroundings of a signal processing unit in the liquid crystal display device according to the embodiment of the present disclosure.

Next, the following describes signal processing in the display device 10 according to the embodiment in detail with reference to FIG. 4. FIG. 4 is a functional block diagram of surroundings of the signal processing unit 20 in the display device 10 according to the embodiment. As illustrated in FIG. 4, the signal processing unit 20 of the liquid crystal display device 10 according to the embodiment includes an .alpha.-value generation unit 21, a color information generation unit 22, and a color information correction processing unit 23.

The input, signals (Rin, Gin, Bin) including a video signal (RGB data) represented by 8 bits (0 to 255) are input to the .alpha.-value generation unit 21 from the outside. The .alpha.-value generation unit 21 calculates an expansion coefficient .alpha. of the input RGB data, and calculates 1/.alpha. based on the calculated expansion coefficient .alpha. The .alpha.-value generation unit 21 outputs the calculated expansion coefficient .alpha. and 1/.alpha. to the color information generation unit 22 together with the input signals as output signals.

The color information generation unit 22 generates a light source device control signal (BLPWM) for controlling luminance of the light source 54 based on the input signals input from the .alpha.-value generation unit 21, and outputs the generated light source device control signal to the light source device control circuit 60.

The color information generation unit 22 performs linear conversion as reverse .gamma. correction on the input RGB data. When the input signal is the RGB data represented by 8 bits (0 to 255), for example, the color information generation unit 22 normalizes each value of an R component, a G component, and a B component of the RGB data to be a value of 0 to 1. The color information generation unit 22 calculates, with respect to the normalized RGB data, RGBW data including data of the W (white) component for driving the fourth sub-pixel 49W in the main pixel 48.

When the input signals (Rin, Gin, Bin) and the output signals (Rout, Gout, Bout) are the RGB data represented by 8 bits (0 to 255), for example, the color information generation unit 22 converts the generated RGBW data into 8-bit data similarly to the input signals and the output signals. The color information generation unit 22 then executes .gamma. correction processing with a .gamma. value (for example, .gamma.=2.2) of the input signal on which .gamma. correction is performed, and calculates the output signals (Rout, Gout, Bout, Wout) of the .gamma.-corrected RGBW data.

The color information generation unit 22 extends the RGB data of the input signals based on the following expressions (1) to (3) corresponding to the luminance of the light source 54, and calculates the extended RGB data (R', G', B').

R'=Gain.times.Rin expression (1)

G'=Gain.times.Gin expression (2)

B'=Gain.times.Bin expression (3)

(in the expressions (1) to (3), Gain represents an inverse number of a light source luminance ratio.)

The color information generation unit 22 calculates the output signal of the first sub-pixel 49R based on the input signal of the first sub-pixel 49R, the expansion coefficient .alpha., and the output signal of the fourth sub-pixel 49W. The color information generation unit 22 calculates the output signal of the second sub-pixel 49G based on the input signal of the second sub-pixel 49G, the expansion coefficient .alpha., and the output signal of the fourth sub-pixel 49W. The color information generation unit 22 calculates the output signal of the third sub-pixel 49B based on the input signal of the third sub-pixel 49B, the expansion coefficient .alpha., and the output signal of the fourth sub-pixel 49W. The color information generation unit 22 generates the calculated output signals of the first sub-pixel 49R, the second sub-pixel 49G, the third sub-pixel 49B, and the fourth sub-pixel 49W, and outputs the generated output signals of the RGBW data (first color information) to the color information correction processing unit 23.

The color information correction processing unit 23 determines whether image data of at least one or the first sub-pixel 49R, the second sub-pixel 49G, and the third sub-pixel 49B included in the RGBW data input from the color information generation unit 22 exceeds an expressible range (D_max) that is a predetermined threshold of the display device 10. When the image data of at least one of the first sub-pixel 49R, the second sub-pixel 49G, and the third sub-pixel 49B exceeds the expressible range, the color information correction processing unit 23 calculates a rate of excessive amount of the data exceeding the expressible range with respect to the expressible range. The predetermined threshold of the display device 10 is not necessarily limited to the expressible range, and may be appropriately modified.

Specifically, the information correction processing unit 23 calculates an excessive rate (D_over) of the extended image data (R', G', B') with respect to the maximum display range (D_max) of the display device 10 based on the following expression (4).

D_over=MAX(*R', G', B'*)/*D*_max expression (4)

The color information correction processing unit 23 degenerates each piece of the data of the first sub-pixel 49R, the second sub-pixel 49G, and the third sub-pixel 49B corresponding to the calculated excessive rate. The color information correction processing unit 23 adds the sum total of degeneration amounts of pieces of image data of the first sub-pixel 49R, the second sub-pixel 49G, and the third sub-pixel 49B to the image data of the fourth sub-pixel 49W to be corrected RGBW data (second color information). Accordingly, the ratio among the first sub-pixel 49R, the second sub-pixel 49G, and the third sub-pixel 49B is not changed and the image data of the fourth sub-pixel 49W can be added, so that high saturation and high value can be achieved even when luminous intensity of the light source is reduced. The image data to be added to the fourth sub-pixel 49W is not necessarily limited to the sum total of the degeneration amounts of pieces of the image data of the first sub-pixel 49R, the second sub-pixel 49G, and the third sub-pixel 49B, and may be appropriately modified.

Specifically, when the extended image data exceeds the maximum display range of the display device 10, the color information correction processing unit 23 uses image data (R", G", B"), which is the image data degenerated to be within the expressible range, as RGB output signals (Rout, Gout, Bout) based on the following expressions (5) to (7). When the extended image data does not exceed the maximum display range of the display device 10, the color information correction processing unit 23 uses the extended image data (R', G', B') as the RGB output signals (Rout, Gout, Bout) as it is.

*R"=R'/D*_over expression (5)

*G"=G'/D*_over expression (6)

*B"=B'/D*_over expression (7)

Subsequently, when the extended image data exceeds the maximum display range, the color information correction processing unit 23 calculates the excessive amounts (R_over, G_over, B_over) based on the following expressions (8) to (10). When the extended image data does not exceed the maximum display range, the color information correction processing unit 23 sets the excessive amount to 0.

*R*_over=*R'*−*R"*expression (8)

*G*_over=*G'*−*G"*expression (9)

*B*_over=*B'*−*B"*expression (10)

The color information correction processing unit 23 then converts the calculated excessive amount into value to be allocated to an output (Wout) of the fourth sub-pixel 49W based on the following expression (11).

*W*_out=(*R*_over.times.R.sub.--*Y*+*G*_over.times.*G*.sub.--*Y*+*B*_over.times.*B*.sub.---*Y*)/*W*_*Y* expression (11)

(In the expression (11), R_Y represents a value ratio of an R pixel, Gy represents a value ratio of a G pixel, B_Y represents a value ratio of a B pixel, and W_Y represents a value ratio of a W pixel.)

The functions of the .alpha.-value generation unit 21, the color information generation unit 22, and the color information correction processing unit 23 may be implemented by hardware or software, and are not specifically limited. Even if each component of the signal processing unit 20 is configured by hardware, each circuit does not need to be physically and independently distinguished from each other, and a plurality of functions may be implemented by a physically single circuit.

Figure 5A:
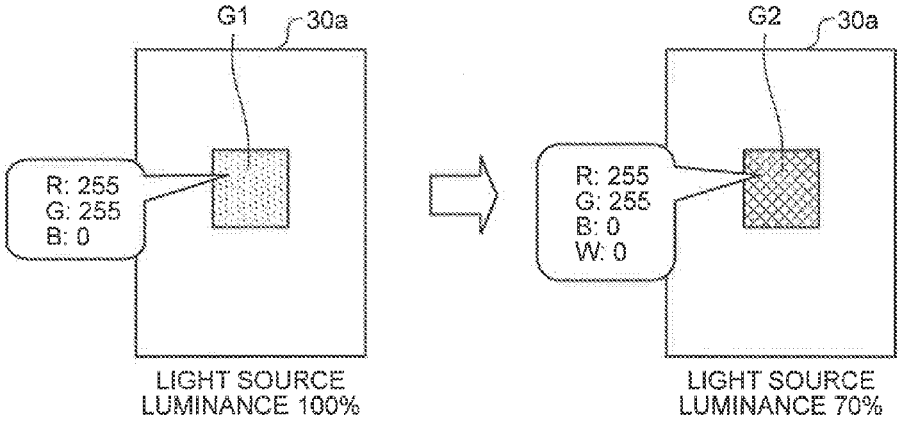
FIG. 5A is an explanatory diagram illustrating a relation between light source luminance of an RGB-type display device and a displayed image in an image display region.
Figure 5B:
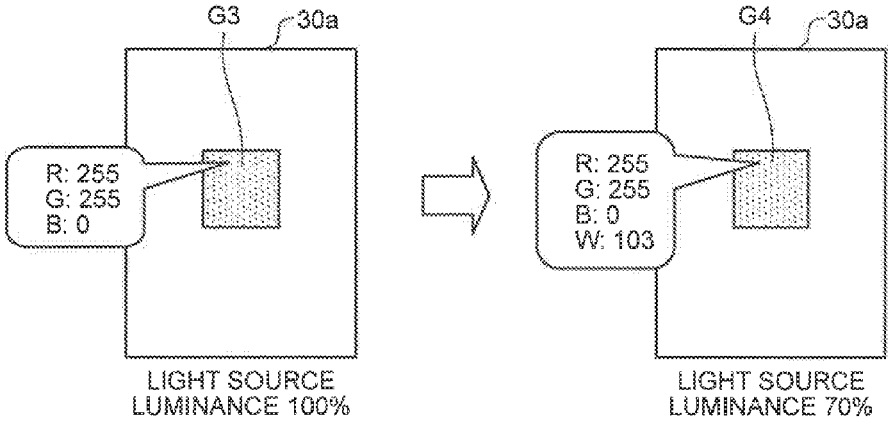
FIG. 5B is an explanatory diagram illustrating a relation between light, source luminance of an RGBW-type display device and a displayed image in an image display region.

The following describes a relation between light source luminance and a displayed image in the image display region 30*a* of the RGB-type display device and the RGBW-type display device with reference to FIG. 5A and FIG. 5B, FIG. 5A is an explanatory diagram illustrating a relation between the light source luminance and the displayed image in the image display region 30*a* of the RGB-type display device 10, and FIG. 5B is an explanatory diagram illustrating a relation between the light source luminance and the displayed image in the image display region 30*a* of the RGBW-type display device 10.

As illustrated in FIG. 5A, in the conventional RGB-type display device, when the light source luminance is reduced from 100% to 70%, luminance of a white screen on the background of the image display region 30*a* can be kept constant. A yellow high-saturation image G1 (red (R) pixel: 255, green (G) pixel: 255) displayed in a part of the image display region 30*a* is caused to be a high-saturation intermediate-value image G2 because the value is reduced and darkening is caused due to the reduction in the light source luminance.

Accordingly, as illustrated in FIG. 5B, when the light source luminance is reduced from 100% to 70% in the RGBW-type display device according to the present disclosure, a white (W) pixel: 103 is added to a yellow high-saturation image G3 (red (R) pixel: 255, green (G) pixel: 255) corresponding to a reduction amount of the light source luminance. Accordingly, the value of the high-saturation high-value image G3 as the input image is compensated with the white pixel even if the light source luminance thereof is reduced, so that a high-saturation high-value image G4 can be maintained.

Figure 6A:
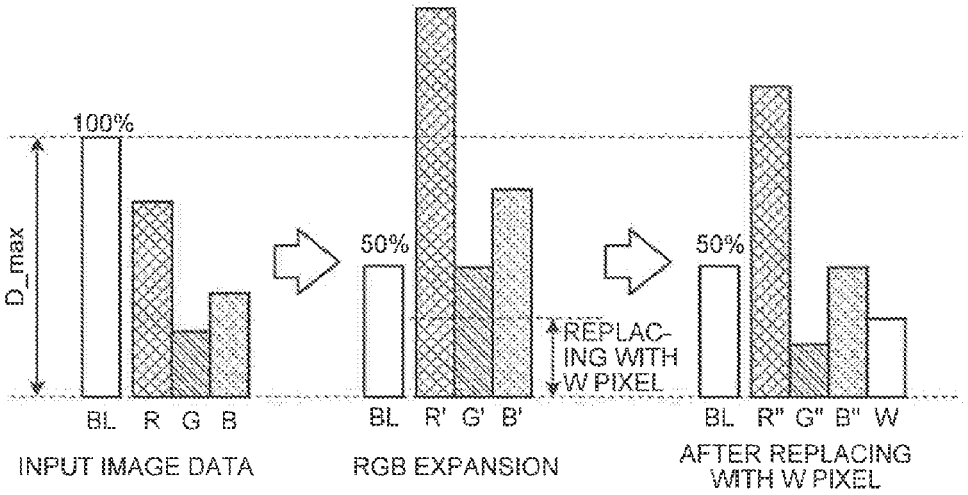
FIG. 6A is a diagram illustrating an example of correction processing of value (also called as brightness or luminance) of an input image in a conventional RGBW-type display device.
Figure 6A:
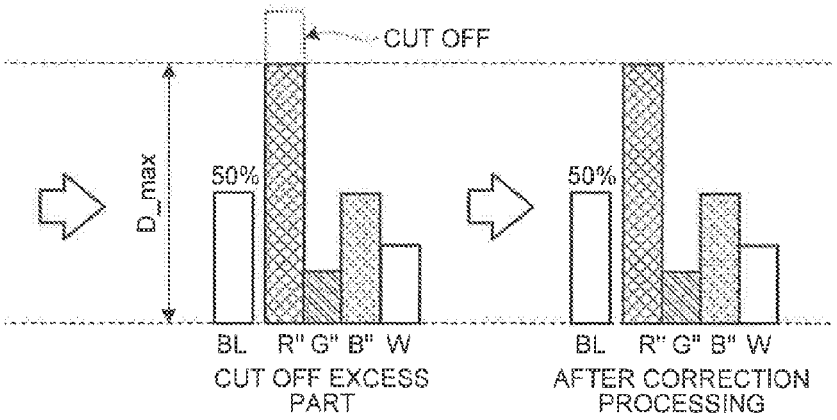
Figure 6B:
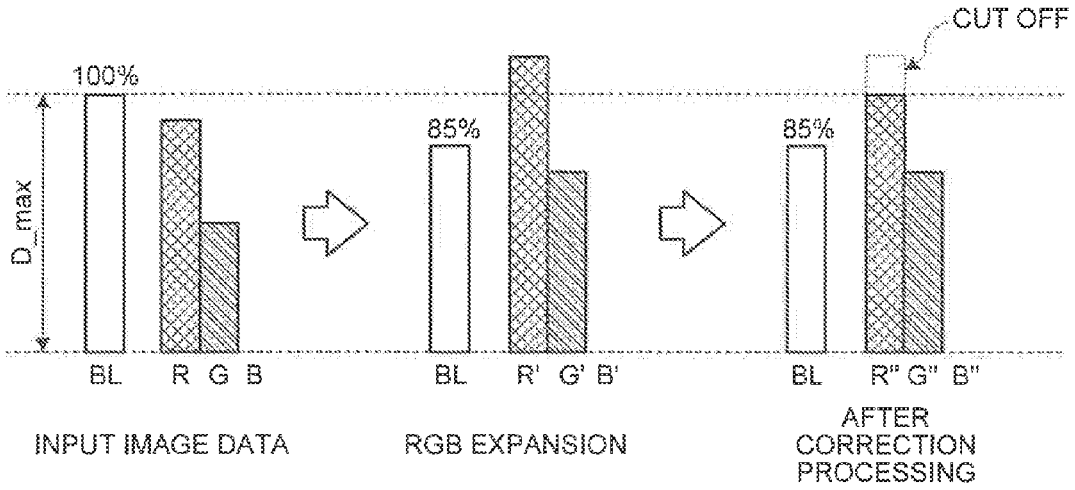
FIG. 6B is a diagram illustrating another example of the correction processing of the value of the input image in the conventional RGBW-type display device.

Next, the following describes correction processing of the input image in the conventional RGBW-type display device in detail with reference to FIG. 6 and FIG. 6B. FIG. 6A is a diagram illustrating an example of the correction processing of the value of the input image in the conventional RGBW-type display device, and FIG. 6B is a diagram illustrating another example of the correction processing of the value of the input image in the conventional RGBW-type display device.

FIG. 6A illustrates an example of the correction processing in which the input image data includes red(R) green (G), and blue (B) components. In this case, after light source (BL) luminance is reduced from 100% to 50% in the expressible range (D_max) with respect to the input image data, the image data including the red (R), the green (G), and the blue (B) components is extended corresponding to the reduction amount of the light source luminance to keep the value of the image. As a result, the red (R), the green (G), and the blue (B) components included in the image data become red (R'), green (G'), and blue (B') components, each of which is extended by 2 times. Regarding the red (R') component, an excess part exceeding the expressible range is generated.

Subsequently, the common portion of the extended data of the red (R'), the green (G'), and the blue (B') components is replaced with a white (W) component. Due to this, each piece of the data of the red (R'), the green (G'), and the blue (B') components is reduced, and reduction of the light source luminance can be compensated with the added white (W) component. Finally, the excess part exceeding the expressible region of the image data of the red (R') component is cut off to be within the expressible range (D_max), and the correction processing is finished.

FIG. 6B illustrates an example of the correction processing in which the input image data includes the red (R) and the green (G) components. In this case, after the light source (BL) luminance is reduced from 100% to 85% in the expressible range (D_max) with respect to the input image data, the image data including the red (R) and the green (G) components is extended corresponding to the reduction amount of the light source luminance to keep the value of the image. Accordingly, the red (R) and the green (G) components included in the image data become the red (R') and the green (G') components, each of which is extended by 1.25 times, so that the reduction of the light source luminance can be compensated. Finally, the excess part exceeding the expressible range of the red (R') component that is generated in the expansion processing is cut off to be within the expressible range (D_max), and the correction processing is finished.

As described above, in the conventional RGBW-type display device, the correction processing is performed for cutting off the excess part of the red (R), the green (G), and the blue (B) image data generated in the expansion processing of the input image data, the excess part exceeding the expressible range of the display device. Due to this, although it is possible to compensate the reduction in value caused by the reduction in light source luminance in the expansion processing, the ratio among the pieces of input image data of red (R), green (G), and blue (B) may be changed to cause change in a hue and the like before and after the expansion processing. FIG. 6A and FIG. 6B illustrate an example of such a case. Accordingly, in the embodiment, the correction processing is performed to maintain the ratio among the pieces of image data of red (R), green (G), and blue (B) as follows.

Figure 7A:
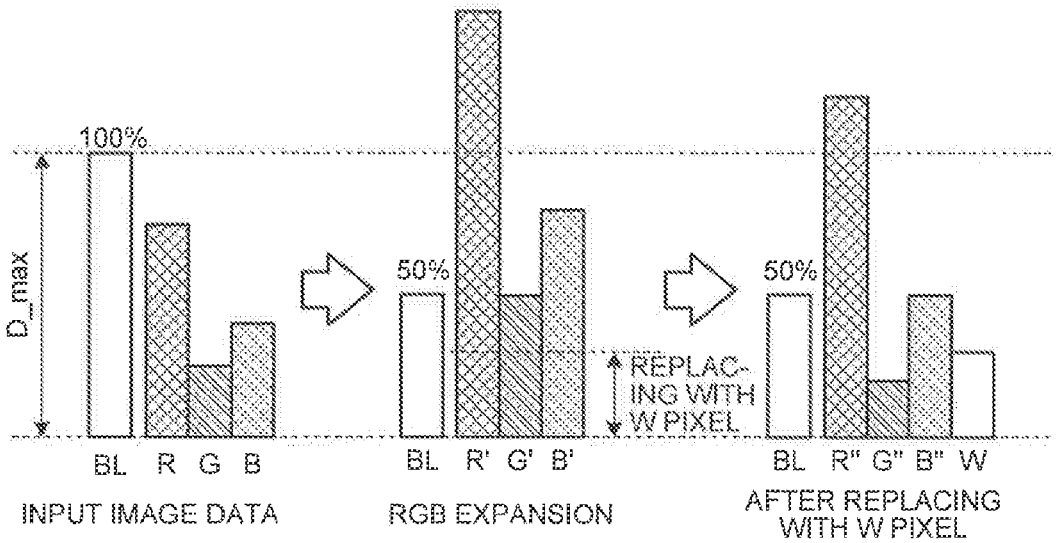
FIG. 7A is a diagram illustrating an example of correction processing of value of an input image in the display device according to the embodiment.
Figure 7A:
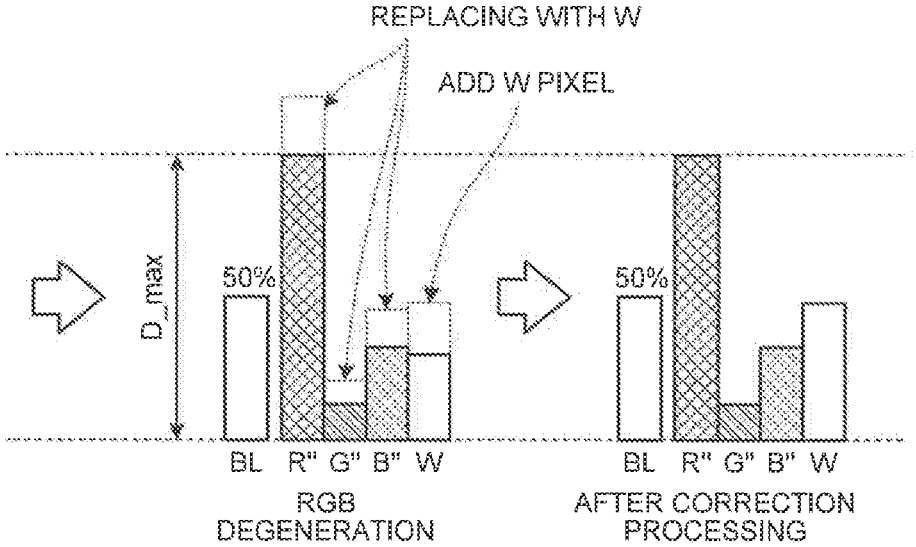
Figure 7B:
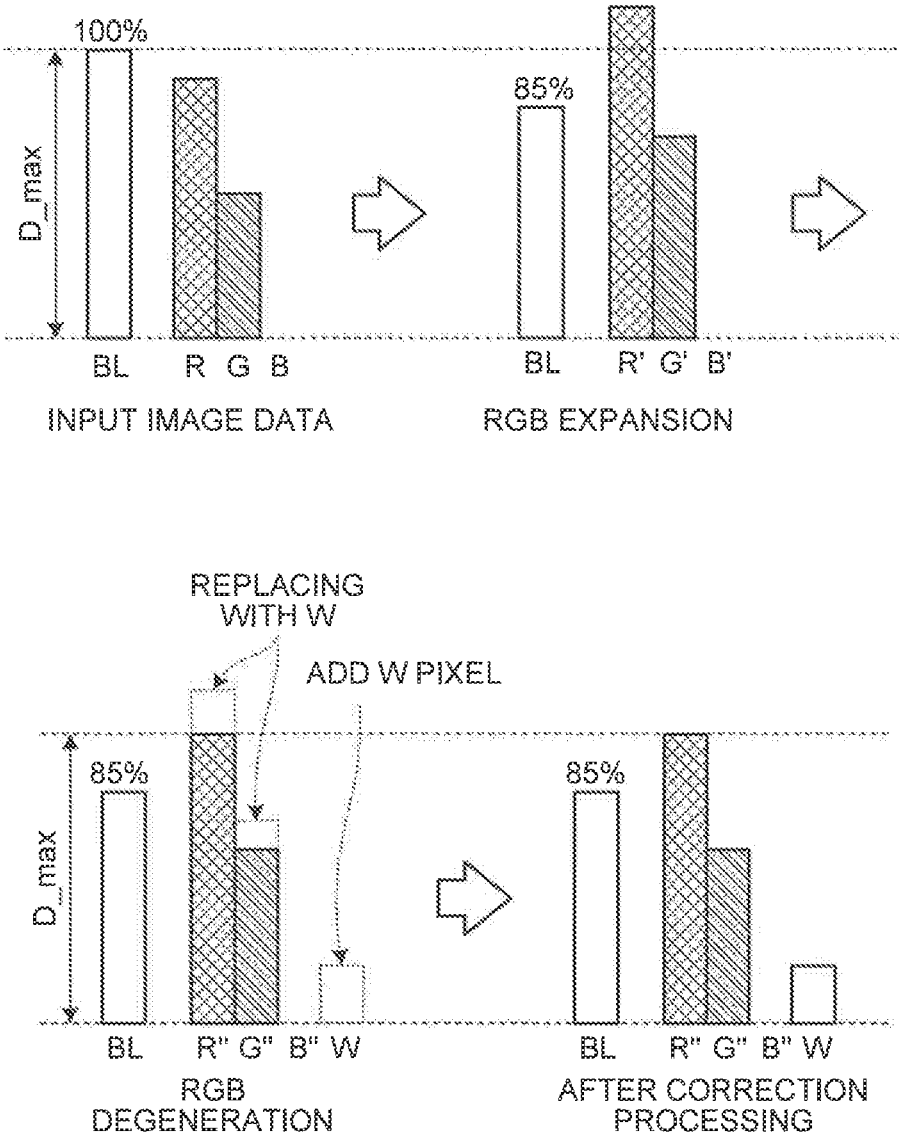
FIG. 7B is a diagram illustrating another example of the correction processing of the value of the input image in the display device according to the embodiment.

Next, the following describes the correction processing of the input image in the display device according to the embodiment in detail with reference to FIG. 7A and FIG. 7B. FIG. 7A is a diagram illustrating an example of the correction processing of the input image in the display device according to the embodiment, and FIG. 7B is a diagram illustrating another example of the correction processing of the input image in the display device according to the embodiment.

FIG. 7A illustrates an example of the correction processing in which the input image data includes the red (R), the green (G), and the blue (B) components. In this case, the color information generation unit 22 reduces the light source (BL) luminance from 100% to 50% in the expressible range (D_max) with respect to the input image data, and extends the image data including the red (R), the green (G), and the blue (B) components corresponding to the reduction amount of the light source luminance to keep the value of the image. As a result, the red (R), the green (G), and the blue (B) components included in the image data become the red (R'), the green (G'), and the blue (B') components, each of which is extended by 2 times. Regarding the red (R') component, an excess part exceeding the expressible range is generated.

Subsequently, the color information generation unit 22 replaces the common portion of the extended image data of the red (R'), the green (G'), and the blue (B') components with the white (W) component, generates the RGBW data (first color information.), and outputs the generated RGBW data to the color information correction processing unit 23.

The color information correction processing unit 23 then calculates an excessive rate of the red (R') component data with respect to the expressible region. Subsequently, the color information correction processing unit 23 degenerates the image data of the red (R'), the green (G'), and the blue (B') components to be the image data of red (R"), green (G"), and blue (B") components based on the calculated excessive rate, adds the sum total of pieces of the degenerated image data of red (B"), green (G'), and blue (B') to the white (W) component to be corrected RGBW data (second color information) including the red (R"), the green (G"), the blue (B"), and white (W) components, and the correction processing is finished.

FIG. 7B illustrates an example of the correction processing in which the input image data includes the red (R) and the green (G) components. In this case, the color information generation unit 22 reduces the light source (BL) luminance from 100% to 85% in the expressible range (D_max) with respect to the input image data, and extends the image data including the red (R) and the green (G) components corresponding to the reduction amount of the light source luminance to keep the value of the image. Accordingly, the red (R) and the green (G) components included in the image data become the red (R') and the green (G') components, each of which is extended by 1.25 times. Regarding the red (R') component, an excess part exceeding the expressible range is generated.

Subsequently, the color information generation unit 22 replaces the common portion of the extended image data of the red (R'), the green (G'), and the blue (B') components with the white (W) component, generates the RGBW data (first color information), and outputs the generated RGBW data to the color information correction processing unit 23.

The color information correction processing unit 23 then calculates an excessive rate of the red (R') component data with respect to the expressible region. Subsequently, the color information correction processing unit 23 degenerates the image data of the red (R') and the green (G') components to be the image data of the red (R") and the green (G") components based on the calculated excessive rate, adds the sum total of pieces of the degenerated image data of red (R') and green (G') to the white (W) component to be the corrected RGBW data (second color information) including the red (R"), the green (G"), and the white (W) components, and the correction processing is finished.

As described above, the color information correction processing unit 23 generates the corrected RGBW data from the RGBW data input through the color information generation unit 22 such that all pieces of image data of red (R'), the green (G'), and the blue (B') are within the expressible range and the white (W) is further increased while maintaining the ratio among the pieces of image data of red (R'), green (G'), and blue (B'). Accordingly, the ratio among red (R), green (G), and blue (B) in the input image data is maintained and the input image data can be corrected to image data to which white (W) replaced in the image expansion processing is added, so that it is possible to prevent deterioration of the display quality to be visually recognized that is caused by the deterioration of the hue of the image even when the light source luminance is reduced to reduce the entire power consumption of the display device 10.

Next, the following describes a method for driving the display device according to the embodiment. The method for driving the display device according to the embodiment includes a first step for degenerating color information of the first sub-pixel 49R, the second sub-pixel 49G, and the third sub-pixel 49B included in the first color information (RGBW data before correction) to be displayed on the predetermined main pixel 48, which is obtained based on the luminance of the light source and the input video signal, when the color information of at least one of the first sub-pixel 49B, the second sub-pixel 49B, and the third sub-pixel 49B exceeds the predetermined threshold, and a second step for correcting the first color information to the second color information (corrected RGBW data) by adding color information of the fourth sub-pixel 49W included in the first color information thereto based on the degenerated color information of the first sub-pixel 49R, the second sub-pixel 49G, and the third sub-pixel 49B.

Figure 8:
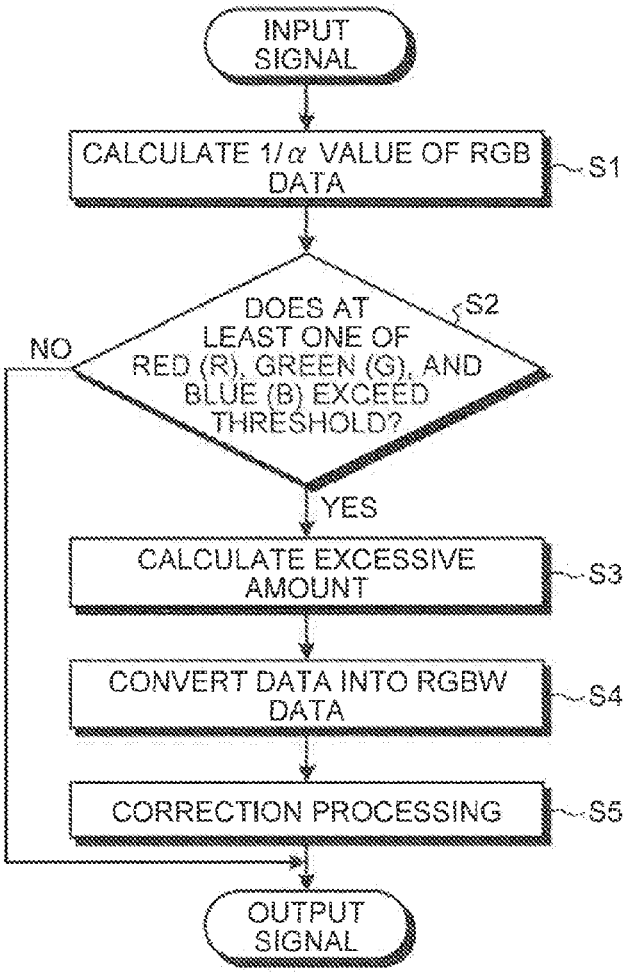
FIG. 8 is a flowchart schematically illustrating a method for driving the display device according to the embodiment.

FIG. 8 is a flowchart schematically illustrating the method for driving the display device according to the embodiment. As illustrated in FIG. 8, first, the .alpha.-value generation unit 21 calculates the expansion coefficient .alpha. based on the input image signal, and calculates 1/.alpha. based on the calculated .alpha. (Step S1). Subsequently, the color information generation unit 22 generates a light source device control signal based on the input signal and outputs the signal to the light source device control circuit 60. The color information generation unit 22 then extends the image data of the first sub-pixel 49R, the second sub-pixel 49G, and the third sub-pixel 49B based on the light source luminance, and replaces the image data common to the first sub-pixel 49R, the second sub-pixel 49G, and the third sub-pixel 49B with the fourth sub-pixel 49W to generate the RGBW data (first color information). The color information generation unit 22 outputs the generated RGBW data to the color information correction processing unit 23.

Next, the color information correction processing unit 23 determines whether the image data of at least one of the first sub-pixel 49R, the second sub-pixel 49G, and the third sub-pixel 49B included in the RGBW data exceeds the predetermined threshold (Step S2). The predetermined threshold herein means, for example, the maximum expressible range of the display device 10, that is, 255 in a case of 8-bit image data. If the image data of at least one of the first sub-pixel 49R, the second sub-pixel 49G, and the third sub-pixel 49B exceeds the predetermined threshold (Yes at Step S2), the color information correction processing unit 23 calculates an excessive amount of the image data of the first sub-pixel 49R, the second sub-pixel 49G, and the third sub-pixel 49B exceeding the threshold (Step S3). The color information correction processing unit 23 degenerates the excessive amount of the first sub-pixel 49R, the second sub-pixel 49G, and the third sub-pixel 49B in the RGBW data based on the calculated excessive amount, and converts the data into the RGBW data to which the image data of the fourth sub-pixel 49W is added based on the calculated excessive amount (Step S4).

The color information correction processing unit 23 corrects the data to the corrected RGBW data (second color information) based on the converted RGBW data (Step 35). Finally, the color information correction processing unit 23 outputs the corrected RGBW data as an output signal to a screen display panel unit 30.

If the image data of at least one of the first sub-pixel 49R, the second sub-pixel 49G, and the third sub-pixel 49B is equal to or smaller than the predetermined threshold (No at Step S2), the color information correction processing unit 23 does not calculate the excessive amount of the first sub-pixel 49R, the second sub-pixel 49G, and the third sub-pixel 49B. In this case, the color information correction processing unit 23 outputs, as the output signal, the image data of the first sub-pixel 49R, the second sub-pixel 49G, the third sub-pixel 49B, and the fourth sub-pixel 49W input from the color information generation unit 22 as the RGBW data (second color information) to the image display panel unit 30.

In the above embodiment, the color information correction processing unit 23 corrects the image data of the white pixel to keep the same value as that of the input image data. However, a correction amount of the image data of the white pixel can be arbitrarily set. For example, by causing the correction amount of the white pixel to be widely variable, the color information correction processing unit 23 may perform correction processing so as to keep only the ratio of the RGB data without correcting the image data of the white pixel from the state in which the image data of the white pixel is corrected to keep the same value as that of the input image data.

Figure 9:
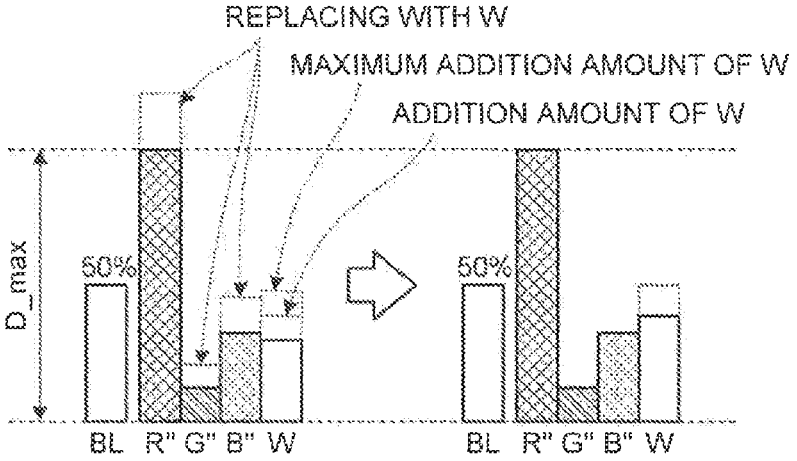
FIG. 9 is a diagram illustrating another example of the display device according to the embodiment.

For example, as illustrated in FIG. 9, under the condition that the value ratio of red (R):green (G):blue (B):white (W) is 18:72:10:150, the color information correction processing unit 23 may set an addition amount of the white (W) pixel to be 50% of the maximum addition amount considering the value ratio between green (G) and white (W). In this case, the addition amount of the white having the value that is substantially two times that of the green (G) is caused to be about half of the green (G), so that the corrected image can be prevented from being whitened.

In the embodiment described above, the color information correction processing unit 23 uniformly adds the white (W) pixel to the RGBW data in the image display region of all high-saturation images in the image display region 30*a*. However, the addition amount of the white (W) pixel to the RGBW data may be appropriately modified corresponding to an area of the displayed image.

Figure 10:
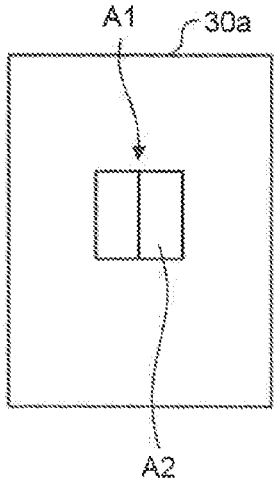
FIG. 10 is a diagram illustrating another example of the display device according to the embodiment.

For example, the color information correction processing unit 23 may provide a predetermined threshold for an area of the high-saturation image, and perform correction processing by reducing the addition amount of the image data of the white pixel when the area of the high-saturation image exceeds the threshold. In the example illustrated in FIG. 10, a partial region A2 that is half of the area of an image display region A1 is set as a threshold of an area of a correction region. In this case, to correct the entire part of the image display region A1 exceeding the partial region A2, the color information correction processing unit 23 may reduce the addition amount of the image data of the white pixel as compared with a case of correcting the partial region A2. Accordingly, the area of the image display region 30*a* to which the white pixel is added is reduced, so that it is possible to prevent color fading accompanying with increase of the white light.

As described above, with the display device 10 according to the embodiment, the color information correction processing unit 23 degenerates the RGB data based on the excessive amount of the image data of RGB included in the RGBW data with respect to the expressible range, and adds W data corresponding to the degenerated RGB data. Accordingly, it is possible to provide the display device 10 that can prevent deterioration of the display quality to be visually recognized caused by the deterioration of the value and the hue even when the luminance of the LEDs 54*a* to 54*e* is reduced to reduce the entire power consumption of the display device 10, and the method for driving the display device 10.

Specifically, according to the embodiment, deterioration of both the value and the hue of the image can be prevented by degenerating the RGB data at a constant ratio and adding the sum total of the degeneration amounts to the W data. Due to this, the effects described above can be more remarkably exhibited.

Next, the following describes an electronic apparatus including the display device 10 according to the embodiment and a controller for controlling the display device 10 with reference to FIG. 11 to FIG. 24. FIG. 11 to FIG. 24 are diagrams illustrating an example of the electronic apparatus including the display device 10 according to the embodiment. The display device 10 can be applied to electronic apparatuses in various fields such as a television apparatus, a digital camera, a notebook-type personal computer, portable terminal devices including a mobile phone, or a video camera. In other words, the display device 10 can be applied to electronic apparatuses in various fields that display a video signal input from the outside or a video signal generated inside as an image or video.

APPLICATION EXAMPLE 1

Figure 11:
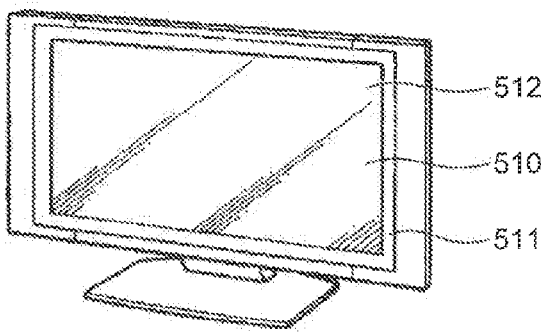
FIG. 11 is a diagram illustrating an example of an electronic apparatus including the display device according to the embodiment of the present disclosure.

The electronic apparatus illustrated in FIG. 11 is a television apparatus to which the display device 10 is applied. The television apparatus includes, for example, a video display screen unit 510 including a front panel 511 and a filter glass 512. The display device 10 is applied to the video display screen unit 510. A screen of the television apparatus has a function for detecting a touch operation, in addition to a function for displaying an image.

APPLICATION EXAMPLE 2

Figure 12:
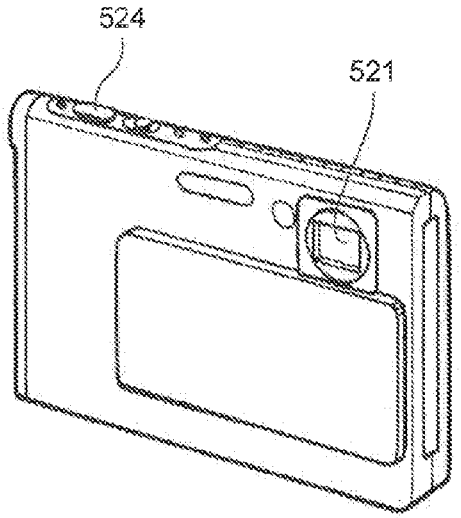
FIG. 12 is a diagram illustrating an example of the electronic apparatus including the display device according to the embodiment of the present disclosure.
Figure 13:
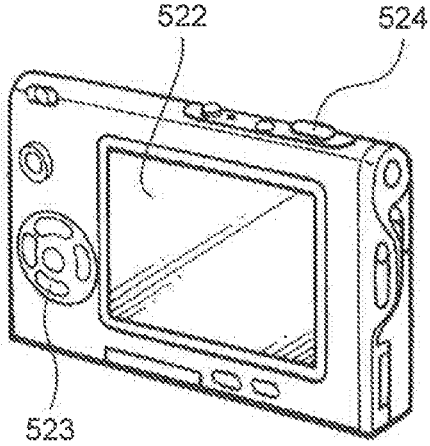
FIG. 13 is a diagram illustrating an example of the electronic apparatus including the display device according to the embodiment of the present disclosure.

The electronic apparatus illustrated in FIG. 12 and FIG. 13 is a digital camera to which the display device 10 is applied. The digital camera includes, for example, a flash light-emitting unit 521, a display unit 522, a menu switch 523, and a shutter button 524. The display device 10 is applied to the display unit 522. Accordingly, the display unit 522 of the digital camera has a function for detecting a touch operation, in addition to a function for displaying an image.

APPLICATION EXAMPLE 3

Figure 14:
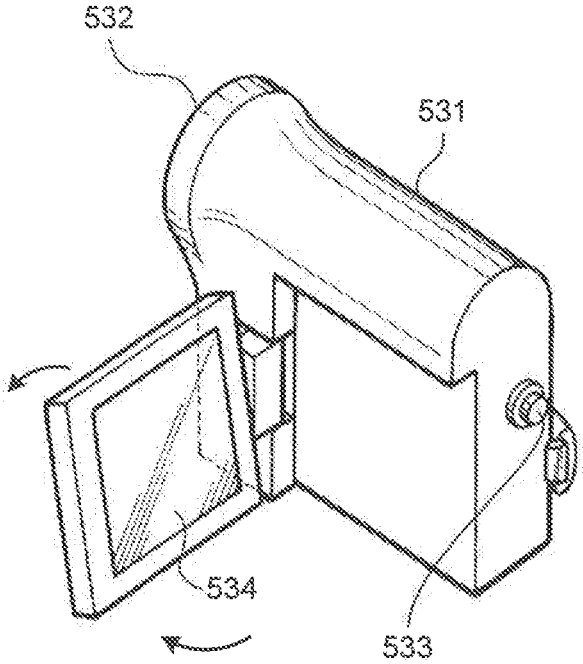
FIG. 14 is a diagram illustrating an example of the electronic apparatus including the display device according to the embodiment of the present disclosure.

The electronic apparatus illustrated in FIG. 14 represents an external appearance of a video camera to which the display device 10 is applied. The video camera includes, for example, a main body 531, a lens 532 for photographing a subject arranged on a front side of the main body 531, a start/stop switch 533 in photographing, and a display unit 534. The display device 10 is applied to the display unit 534. Accordingly, the display unit 534 of the video camera has a function for detecting a touch operation, in addition to a function for displaying an image.

APPLICATION EXAMPLE 4

Figure 15:
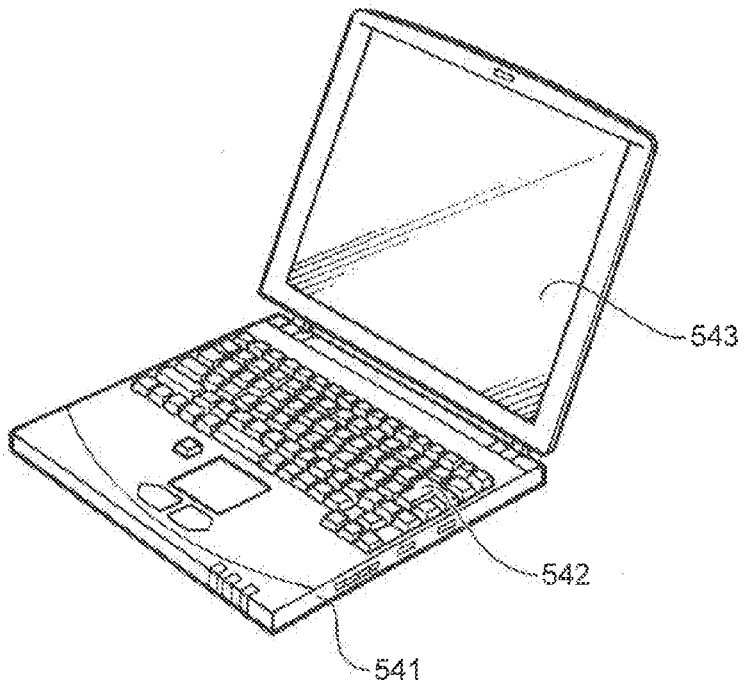
FIG. 15 is a diagram illustrating an example of the electronic apparatus including the display device according to the embodiment of the present disclosure.
Figure 16:
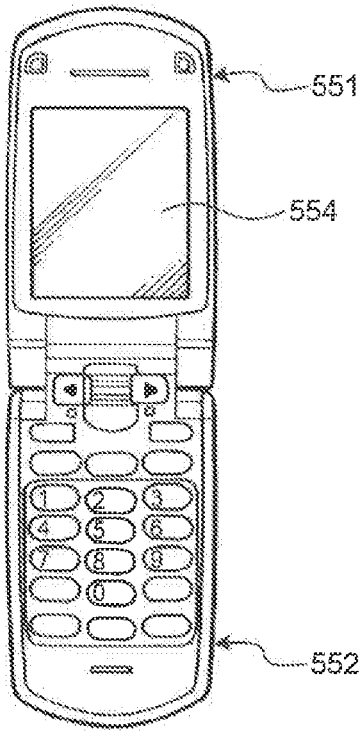
FIG. 16 is a diagram illustrating an example of the electronic apparatus including the display device according to the embodiment of the present disclosure.
Figure 17:
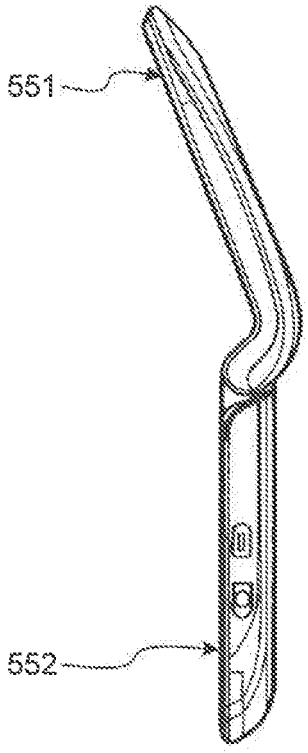
FIG. 17 is a diagram illustrating an example of the electronic apparatus including the display device according to the embodiment of the present disclosure.
Figure 18:
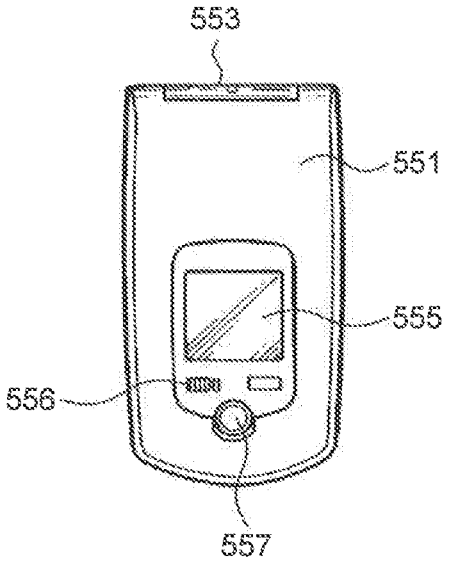
FIG. 18 is a diagram illustrating an example of the electronic apparatus including the display device according to the embodiment of the present disclosure.
Figure 19:
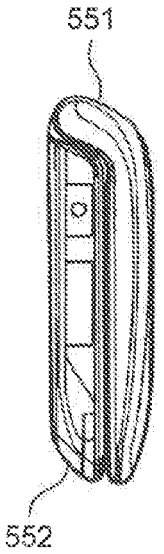
FIG. 19 is a diagram illustrating an example of the electronic apparatus including the display device according to the embodiment of the present disclosure.
Figure 20:
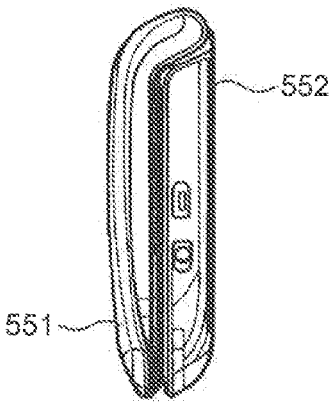
FIG. 20 is a diagram illustrating an example of the electronic apparatus including the display device according to the embodiment of the present disclosure.
Figure 21:
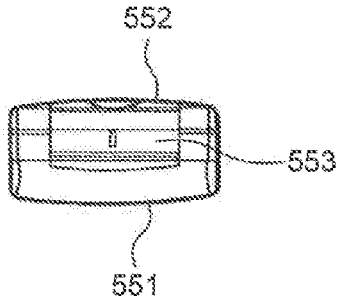
FIG. 21 is a diagram illustrating an example of the electronic apparatus including the display device according to the embodiment of the present disclosure.
Figure 22:
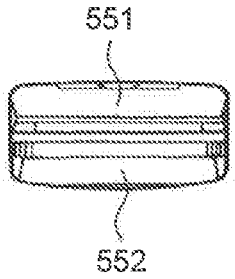
FIG. 22 is a diagram illustrating an example of the electronic apparatus including the display device according to the embodiment of the present disclosure.

The electronic apparatus illustrated in FIG. 15 is a notebook-type personal computer to which the display device 10 is applied. The notebook-type personal computer includes, for example, a main body 541, a keyboard 542 for an input operation of characters and the like, and a display unit 543 for displaying an image. The display device 10 is applied to the display unit 543. Accordingly, the display unit 543 of the notebook-type personal computer has a function for detecting a touch operation, in addition to a function for displaying an image.

APPLICATION EXAMPLE 5

The electronic apparatus illustrated in FIG. 16 to FIG. 22 is a mobile phone to which the display device 10 is applied. The mobile phone is, for example, configured by connecting an upper housing 551 and a lower housing 552 with a connecting part (hinge part) 553, and includes a display unit 554, a sub-display unit 555, a picture light 556, and a camera 557. The display device 10 is mounted as the display unit 554. Accordingly, the display unit 554 of the mobile phone has a function for detecting a touch operation, in addition to a function for displaying an image.

APPLICATION EXAMPLE 6

Figure 23:
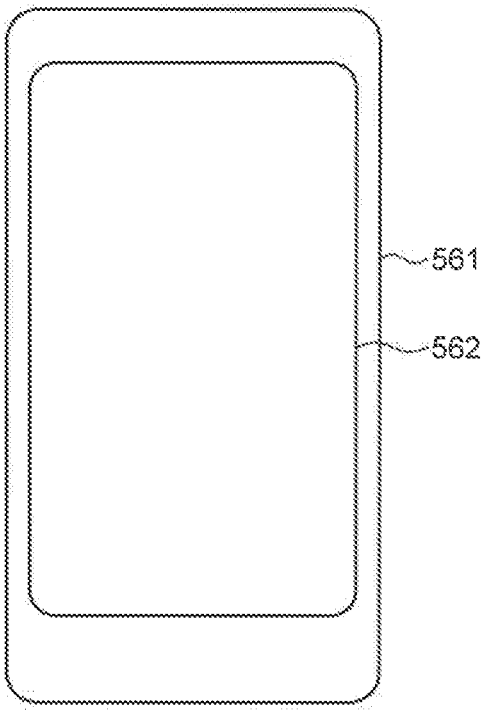
FIG. 23 is a diagram illustrating an example of the electronic apparatus including the display device according to the embodiment of the present disclosure.

The electronic apparatus illustrated in FIG. 23 is a mobile phone, that is, what is called a smartphone, to which the display device 10 and the like are applied. The mobile phone includes, for example, a touch panel 562 arranged on a surface of a substantially rectangular thin-plate housing 561. The touch panel 562 includes the display device 10 and the like.

APPLICATION EXAMPLE 7

Figure 24:
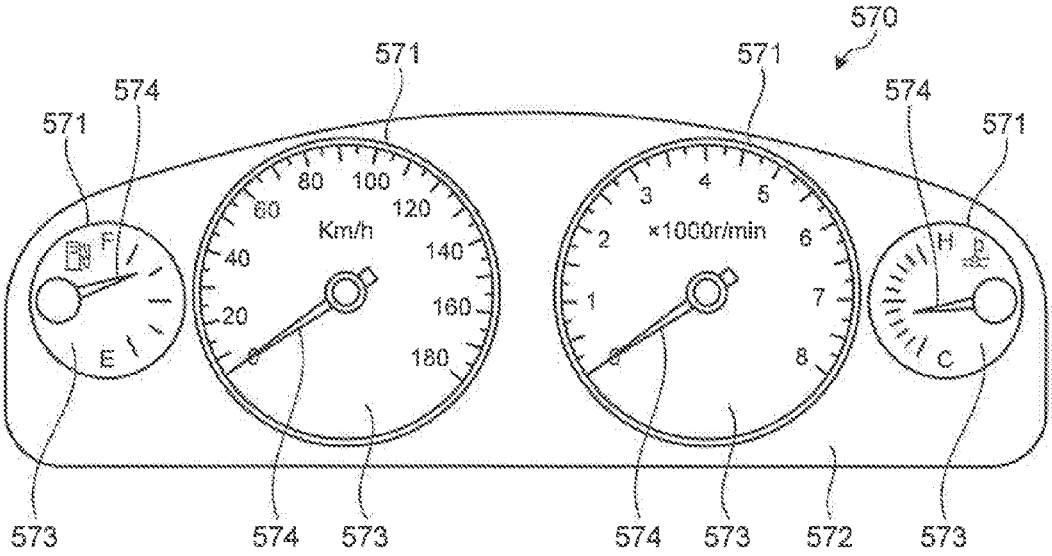
FIG. 24 is a diagram illustrating an example of the electronic apparatus including the display device according to the embodiment of the present disclosure.

The electronic apparatus illustrated in FIG. 24 is a meter unit mounted on a vehicle. A meter unit (electronic apparatus) 570 illustrated in FIG. 24 includes a plurality of liquid crystal display devices 571 such as a fuel gauge, a water-temperature gauge, a speedometer, and a tachometer. The liquid crystal display devices 571 are all covered with one exterior panel 572.

Each of the liquid crystal display devices 571 illustrated in FIG. 24 is configured by combining a liquid crystal panel 573 as liquid crystal display means and a movement mechanism as analog display means. The movement mechanism includes a motor as driving means and an indicator 574 rotated by the motor. As illustrated in FIG. 24, in the liquid crystal display device 571, a scale and a warning can be displayed on a display surface of the liquid crystal panel 573, and the indicator 574 of the movement mechanism can be rotated on the display surface side of the liquid crystal panel 573. The display device 10 according to the embodiment is applied to the liquid crystal display device 571.

In FIG. 24, the liquid crystal display devices 571 are arranged in one exterior panel 572. However, the embodiment is not limited thereto. Alternatively, one liquid crystal display device may be provided in a region surrounded by the exterior panel to display a fuel gauge, a water-temperature gauge, a speedometer, a tachometer, and the like on the liquid crystal display device.

According to the embodiment, the present invention discloses the following display device, method for driving the display device, and electronic apparatus.

A display device including: an image display unit that includes a plurality of main pixels in an image display region, the image display unit including sub-pixels that are a red pixel, a green pixel, a blue pixel, and a white pixel; a light source that irradiates the image display region with illumination light; a light source control unit that controls luminance of the light source; and a color information correction processing unit that corrects first color information that is obtained base on the luminance of the light source and an input video signal to second color information, wherein, when color information of at least one of the red pixel, the green pixel, and the blue pixel included in the first color information exceeds a predetermined threshold, the second information is corrected by degenerating color information of the red pixel, the green pixel, and the blue pixel and by adding color information of the white pixel included in the first color information used on the degenerated color information of the red pixel, the green pixel, and the blue pixel.

The above-described display device, wherein the color information of the red pixel, the green pixel, and the blue pixel included in the first color information is degenerated after the color information of at least one of the red pixel, the green pixel, and the blue pixel is extended.

The above-described display device, wherein the color information correction processing unit corrects the first color information to the second color information while keeping a ratio of color information of the red pixel, the green pixel, and the blue pixel included in the first color information and degenerating the color information.

The above-described display device, wherein the color information correction processing unit corrects the first color information to the second color information by adding the sum total of degeneration amounts of the color information of the red pixel, the green pixel, and the blue pixel included in the first color information to the color information of the white pixel included in the first color information.

The above-described display device, wherein the color information correction processing unit corrects the first color information to the second color information by changing an addition amount of the color information of the white pixel included in the first color information corresponding to a value ratio among the red pixel, the green pixel, the blue pixel, and the white pixel.

The above-described display device, wherein the color information correction processing unit corrects the first color information to the second color information by changing an addition amount of the color information of the white pixel included in the first color information corresponding to an area of an image displayed in the image display region.

A method for driving a display device including: degenerating color information of a red pixel, a green pixel, and a blue pixel included in first color information to be displayed on a predetermined main pixel, the first color information being obtained based on luminance of a light source and an input video signal, when the color information of at least one of the red pixel, the green pixel, and the blue pixel included in the first color information exceeds a predetermined threshold; and correcting the first color information to second color information by adding color information of a white pixel included in the first color information based on the degenerated color information of the red pixel, the green pixel, and the blue pixel.

The above-described method for driving the display device, wherein at the degenerating, the color information of the red pixel, the green pixel, and the blue pixel included in the first color information is degenerated after the color information of at least one of the red pixel, the green pixel, and the blue pixel is extended.

The above-described method for driving the display device, wherein at the degenerating, the color information is degenerated while a ratio of color information of the red pixel, the green pixel, and the blue pixel included in the first color information is kept.

The above-described method for driving the display device, wherein at the correcting, the color information correction processing unit adds the sum total of degeneration amounts of the color information of the red pixel, the green pixel, and the blue pixel included in the first color information to the color information of the white pixel included in the first color information.

The above-described method for driving the display device, wherein at the correcting, an addition amount of the color information of the white pixel included in the first color information is changed corresponding to a value ratio among the red pixel, the green pixel, the blue pixel, and the white pixel.

The above-described method for driving the display device, wherein at the correcting, an addition amount of the color information of the white pixel included in the first color information is changed corresponding to an area of an image displayed in the image display region.

An electronic apparatus including: the above-described display device; and a controller that controls the display device.

The present invention provides the display device that can reduce the entire power consumption of the device by reducing the light source luminance and prevent value and a hue from being deteriorated to reduce deterioration of the display quality to be visually recognized, the method for driving the display device, and the electronic apparatus.

What is claimed is:

1. A display device comprising:

an image display unit that includes a plurality of main pixels in an image display region, the image display unit including sub-pixels that are a red pixel, a green pixel, a blue pixel, and a white pixel;

a light source that irradiates the image display region with illumination light;

a light source control unit that controls luminance of the light source; and a signal processing unit that processes an input signal of the main pixels and outputs an output signal, wherein the signal processing unit:

extends the input signal of the red pixel, the green pixel, and the blue pixel, replaces a common portion of the extended signal of a red component, a green component, and a blue component with a white component, when at least one of the extended signal of the red component, the green component and the blue component exceeds a predetermined threshold, with respect to the exceeded component, degenerates the extended red, green, and blue components, respectively, and adds a sum total of the exceeded red, green, and blue components to the white component.

2. The display device according to claim 1, wherein the signal processing unit degenerates the extended red, green, and blue components, respectively, while keeping a ratio of the input signal of the red, green, and blue components.

3. The display device according to claim 1, wherein:

the light source control unit reduces luminance of the light source, the signal processing unit extends the input signal based on the reduced luminance of the light source.

4. The display device according to claim 1, wherein:

the signal processing unit adds a sum total of degeneration amounts of pieces of the red, the green, and the blue components to the white component as the sum total of the exceeded red, green, and blue components to the white component.

5. A method for driving a display device, the display device comprising an image display unit that includes a plurality of main pixels in an image display region, the image display unit including sub-pixels that are a red pixel, a green pixel, a blue pixel, and a white pixel, the display device further comprising a light source that irradiates the image display region with illumination light, the method comprising:

extending the input signal of the red pixel, the green pixel, the blue pixel, replacing a common portion of the extended signal of a red component, a green component, and a blue component with a white component, when at least one of the extended signal of the red component, the green component, and the blue component exceeds a predetermined threshold, with respect to the exceeded component, degenerating the extended red, green, and blue components, respectively, and adding a sum total of the exceeded red, green, and blue components to the white component.

6. The method for driving a display device according to claim 5, wherein at the degenerating the extended red, green, and blue components, respectively, a ratio of the input signal of the red, green, and blue components is kept.

7. The method for driving a display device according to claim 5, further comprising:

reducing luminance of the light source, at the extending, the input signal is extended based on the reduced luminance of the light source.

8. The method for driving a display device according to claim 5, further comprising:

adding a sum total of degeneration amounts of pieces of the red, the green, and the blue components to the white component as the sum total of the exceeded red, green, and blue components to the white component.

* * * * *